US005706025A

United States Patent [19]

Kerman

[11] Patent Number: 5,706,025

[45] Date of Patent: Jan. 6, 1998

[54] SMOOTH VERTICAL MOTION VIA COLOR PALETTE MANIPULATION

[75] Inventor: Charles W. Kerman, New York, N.Y.

[73] Assignee: Tektronix, Inc., Wilsonville, Oreg.

[21] Appl. No.: 962,063

[22] Filed: Oct. 16, 1992

Related U.S. Application Data

[63] Continuation of Ser. No. 354,581, May 22, 1989, abandoned.

[51] Int. Cl.[6] ..... G09G 5/36

[52] U.S. Cl. ..... 345/136; 345/199; 345/121; 345/150

[58] Field of Search ..... 340/703, 701, 340/723, 728, 724, 726, 747, 744; 345/150, 152, 154, 155, 199, 186, 121, 123, 125, 136; 395/131, 118, 133

[56] References Cited

U.S. PATENT DOCUMENTS 4,704,605 11/1987 Edelson ..... 340/728
4,808,984 2/1989 Trueblood et al. ..... 340/703
4,849,746 7/1989 Dubmer ..... 340/728
4,908,610 3/1990 Yamamuro et al. ..... 340/703

OTHER PUBLICATIONS

James D. Foley "Fundamentals of Interactive Computer Graphics," 1982, pp. 691 to 692.

*Primary Examiner*—Dennis-Doon Chow
*Attorney, Agent, or Firm*—Francis I. Gray; John Smith-Hill

[57] ABSTRACT

Smooth vertical movement of a graphics image on a raster display is performed via color palette manipulation at any speed. A color look-up table has a color palette position for each color within the graphics image plus unassigned color palette positions that are assigned to pixels on the top of horizontal color edges of the graphics image. During movement of the graphics image the color values of the assigned color palette positions are updated each display cycle as a function of a desired rate of vertical movement of the graphics image.

12 Claims, 6 Drawing Sheets

SMOOTH VERTICAL MOTION VIA COLOR PALETTE MANIPULATION

This is a continuation of application Ser. No. 07/354,581 filed May 22, 1989 and now abandoned.

BACKGROUND OF THE INVENTION

The present invention relates to the electronic generation of graphics images on a raster display, and more particularly to smooth vertical motion of a graphics image on a video raster display via color palette manipulation to create the appearance of smooth motion at any motion speed, such as the scrolling of text graphics on a teleprompter system.

The appearance of motion is limited spatially and temporally by various aspects of the hardware used for displaying video graphic information. Spatial resolution for vertical motion is dependent upon the number of scan lines, while temporal resolution is limited by the speed with which scan line data may be changed using the display hardware. There are many ways to increase the limits on these two dimensions: increase the number of scan lines, increase the speed at which the picture may be changed, alter the scan line positions, etc.

One particular method for providing smooth vertical scrolling is described in allowed, co-pending U.S. patent application Ser. No. 06/848,599, now U.S. Pat. No. 4,849,746 filed Apr. 7, 1986 by Robert J. Dubner entitled "Digital Video Generator" that uses weighting factors to combine intensities from a current pixel and a next pixel from consecutive lines in the direction of movement to create an apparent partial pixel movement based upon the desired speed of motion. This system uses a display memory having a capacity more than twice that necessary for display on a video display, and several pointer registers. This approach is hardware intensive and uses several pointers that are updated each display cycle.

What is desired is smooth vertical motion at any speed of a graphics image on a raster display, which motion does not require drastically special hardware.

SUMMARY OF THE INVENTION

Accordingly the present invention provides smooth vertical motion for a graphics image on a video raster display using color palette manipulation. A raster display halving a graphics image to be moved is converted into video data in the form of pixels, each pixel having a color value in the form of an address for a color look-up table. The pixels are pre-processed to find all horizontal edges and to reassign the color palette address for any pixel above the edges to previously unassigned addresses of the color look-up table. After pre-processing the graphic image is moved by mixing colors on opposite sides of the edges as a function of a selected speed of movement in units of scan lines per change period for the previously unassigned addresses. When displayed, the pixels above the edges are blended to provide apparent partial movement from one scan line to the next for each display cycle. The movement algorithm iterates for as many change periods, or display cycles, as required for the desired movement of the graphics image.

The objects, advantages and other novel features of the present invention are apparent from the following detailed description when read in conjunction with the appended claims and attached drawing.

DESCRIPTION OF THE PREFERRED EMBODIMENT

Figure 1A:
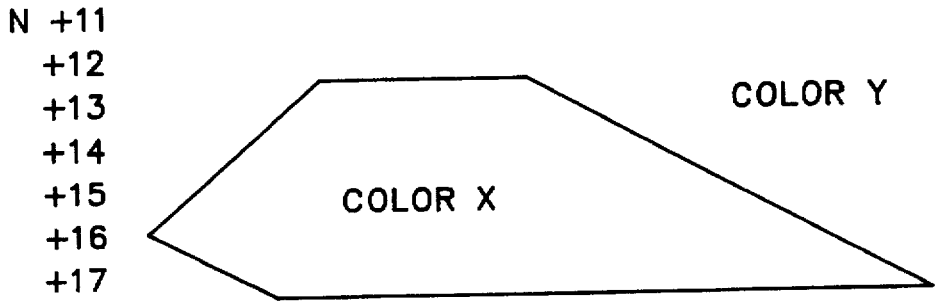
FIGS. 1*a*, 1*b*, and 1*c* illustrate pre-processing of video data for an arbitrary graphic image to be moved vertically on a raster display according to the present invention.
Figure 1B:
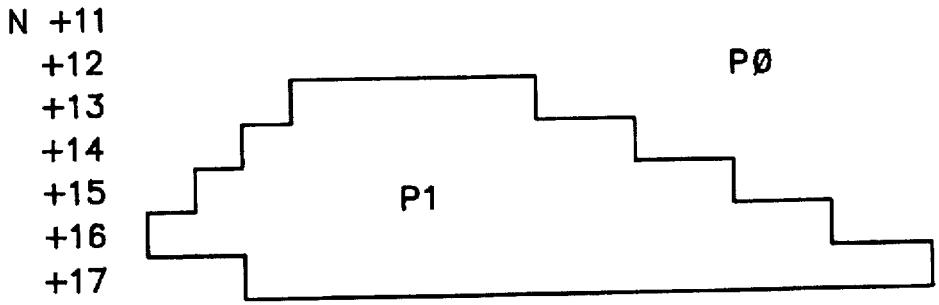
Figure 1C:
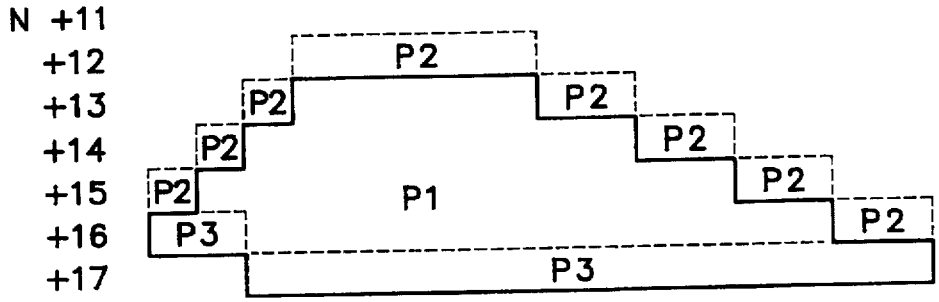
Figure 2A:
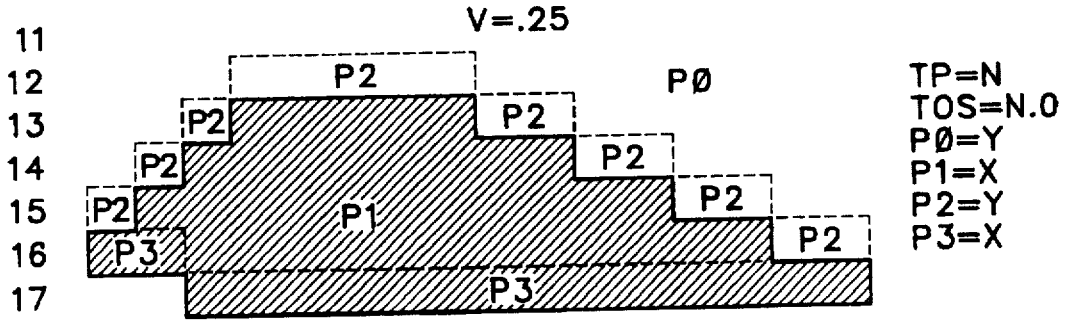
FIGS. 2*a*, 2*b*, 2*c*, 2*d* and 2*e* illustrate moving of the pre-processed video data for the graphic image to produce motion according to the present invention.
Figure 2B:
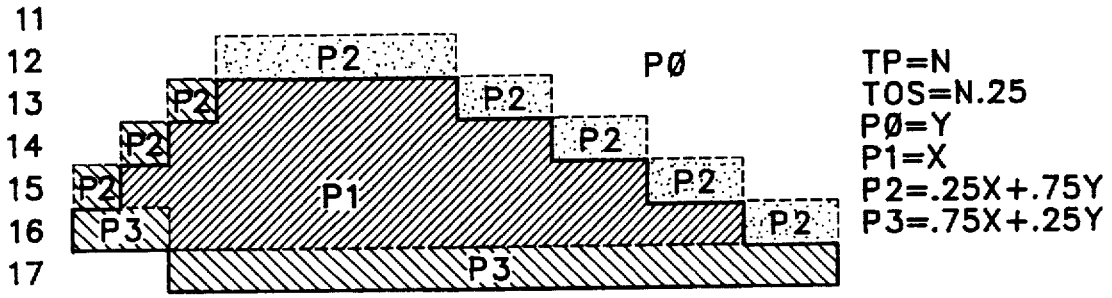
Figure 2C:
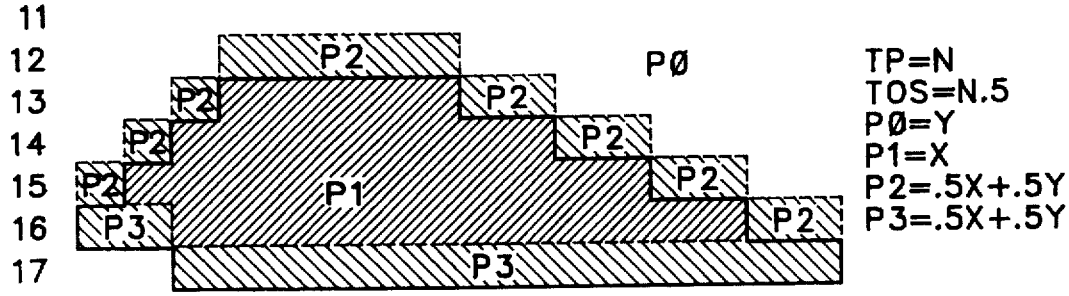
Figure 2D:
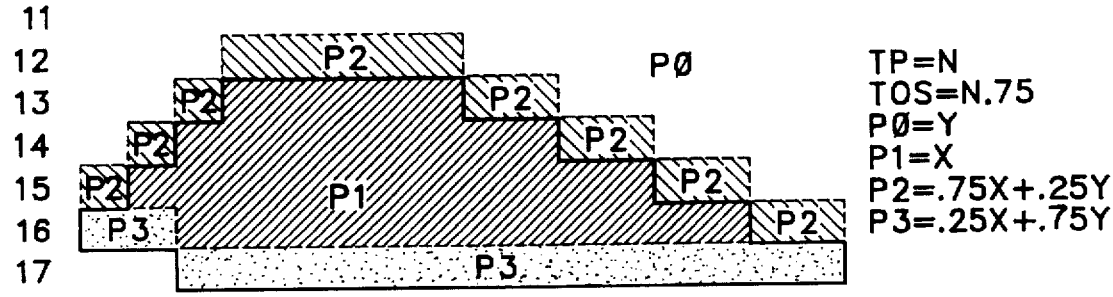
Figure 2E:
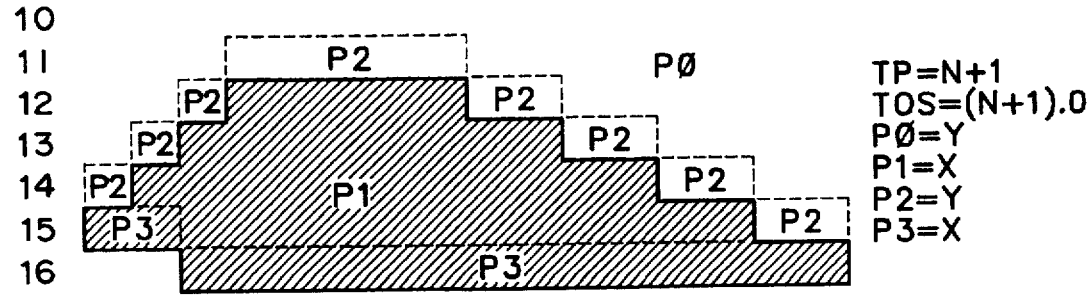

Referring now to FIG. 1*a* a trapezoid of color X is shown on a background of color Y. If no motion is required, this image could be rendered as shown in FIG. 1*b*. A top pointer (TP) is set to N and the trapezoid is placed with the top on the thirteenth scan line (N+13). As shown, five scan lines of data and two palette positions are required to display the trapezoid. Palette positions are assigned as: P0=color Y; and P1=color X. Now to move the trapezoid upward on the display device at any speed, a pre-processing algorithm is first performed on the video data shown in FIG. 1*b*. The pre-processing algorithm examines all horizontal edges and reassigns the palette position of any pixel above an edge as follows: one new palette position for every unique combination of below edge color and replaced pixel color. Thus all pixels resting on a pixel edge of color P1 and replacing color P0 are assigned P2, and all pixels resting on a pixel edge of color P0 and replacing color P1 are assigned P3 as indicated in FIG. 1*c*.

A choice is made for the speed of vertical motion, V, in units of scan lines per change period. V may have a fractional value limited by the output of a color look-up table (CLUT). For the following example the fractional part of V has a resolution of 0.25 scan lines per field where the change period is one field in duration. FIGS. 2*a*–2*e* show movement progression with the period between each figure being one field. The four color palette positions, P0–P3, determined by the pre-processing algorithm, the top pointer, TP, and the top of screen (TOS) for each field are shown at the right of each figure. Changes in the values for these registers may be made during the vertical interval period. As shown by the formulas for palette positions P2 and P3, the color for the pixels above the edges are gradually mixed together from the values at palette positions P0 and P1 from one field to the next according to the fractional portion of TOS until TP is incremented by one scan line and the appearance of the trapezoid is one scan line higher. This motion algorithm is repeated for as much vertical motion as is desired.

Figure 3:
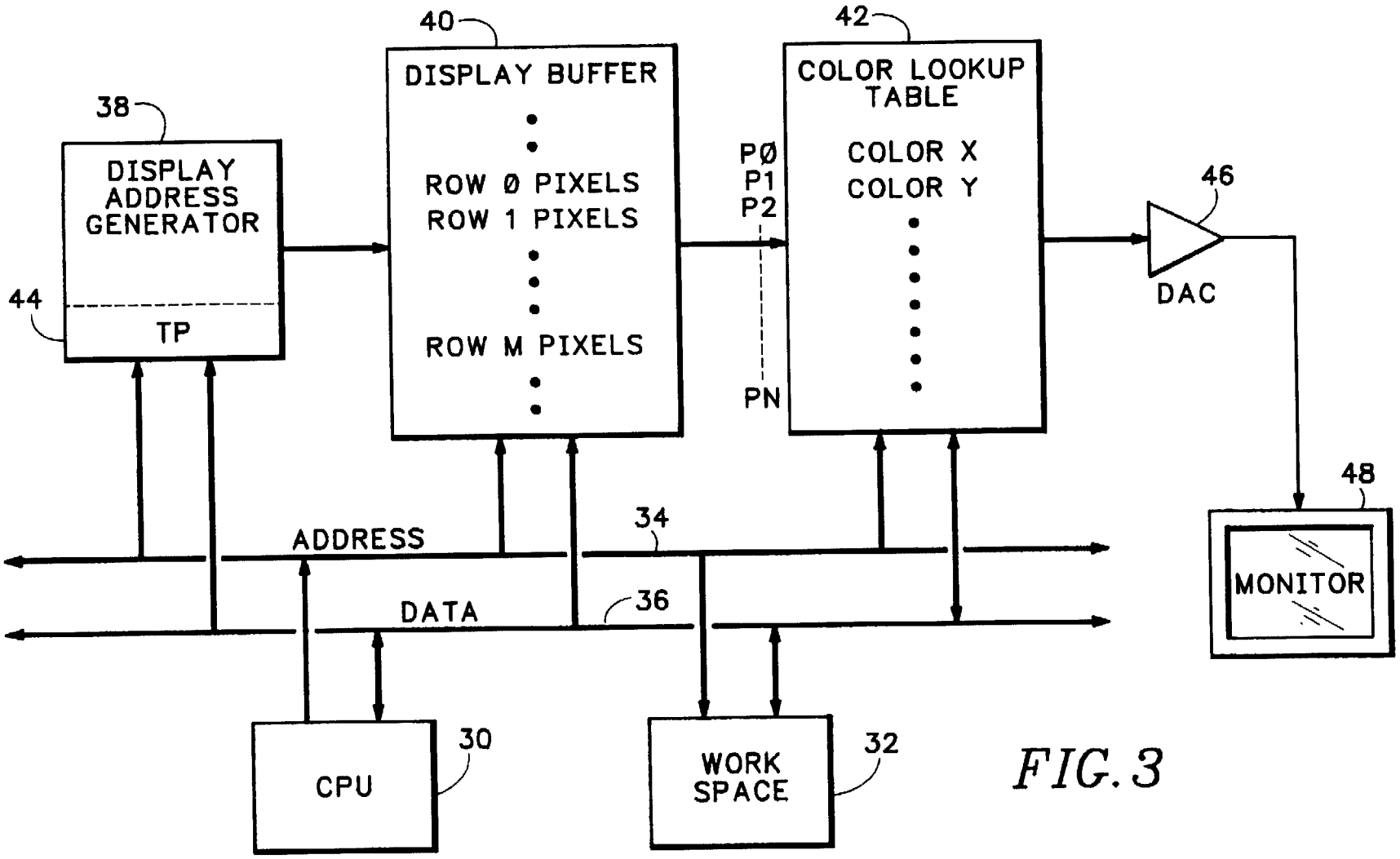
FIG. 3 is a block diagram of a hardware configuration for performing smooth vertical motion of a graphic image according to the present invention.

A system to implement smooth vertical motion of a graphics image is shown in FIG. 3. This is a computer based system having a central processing unit 30 with a work space 32, such as a random access memory (RAM), tied to common address and data buses 34, 36. A display system includes a display address generator 38, a display buffer 40 and a color look-up table memory 42, all tied to the common address and data buses 34, 36. The display address generator 38 has a top pointer (TP) register 44 that is loaded by the CPU 30 at the start of each change period to indicate which pixel line appears at the top of a monitor screen. The display address generator 38 generates addresses for the display buffer 40 to select the pixels currently being processed. The color look-up number, or look-up table address, for a selected pixel is used to access the color look-up table memory 42 to select an output color value for that pixel for display. The selected color value is input to a video digital-to-analog converter 46, the output of which drives a picture monitor 48.

Figure 4A:
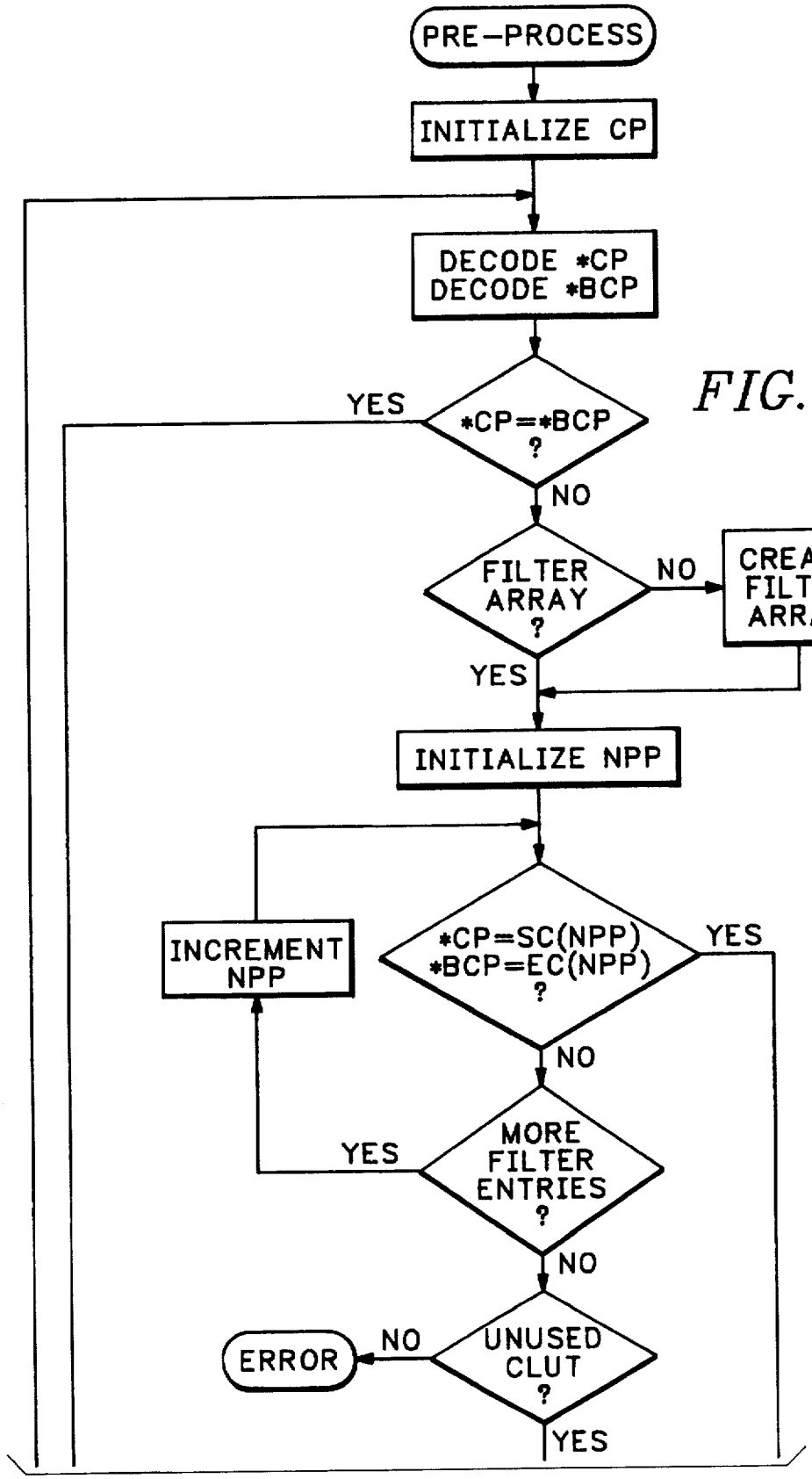
FIGS. 4*a* and 4*b* are a flow chart of the pre-processing algorithm according to the present invention.
Figure 4B:
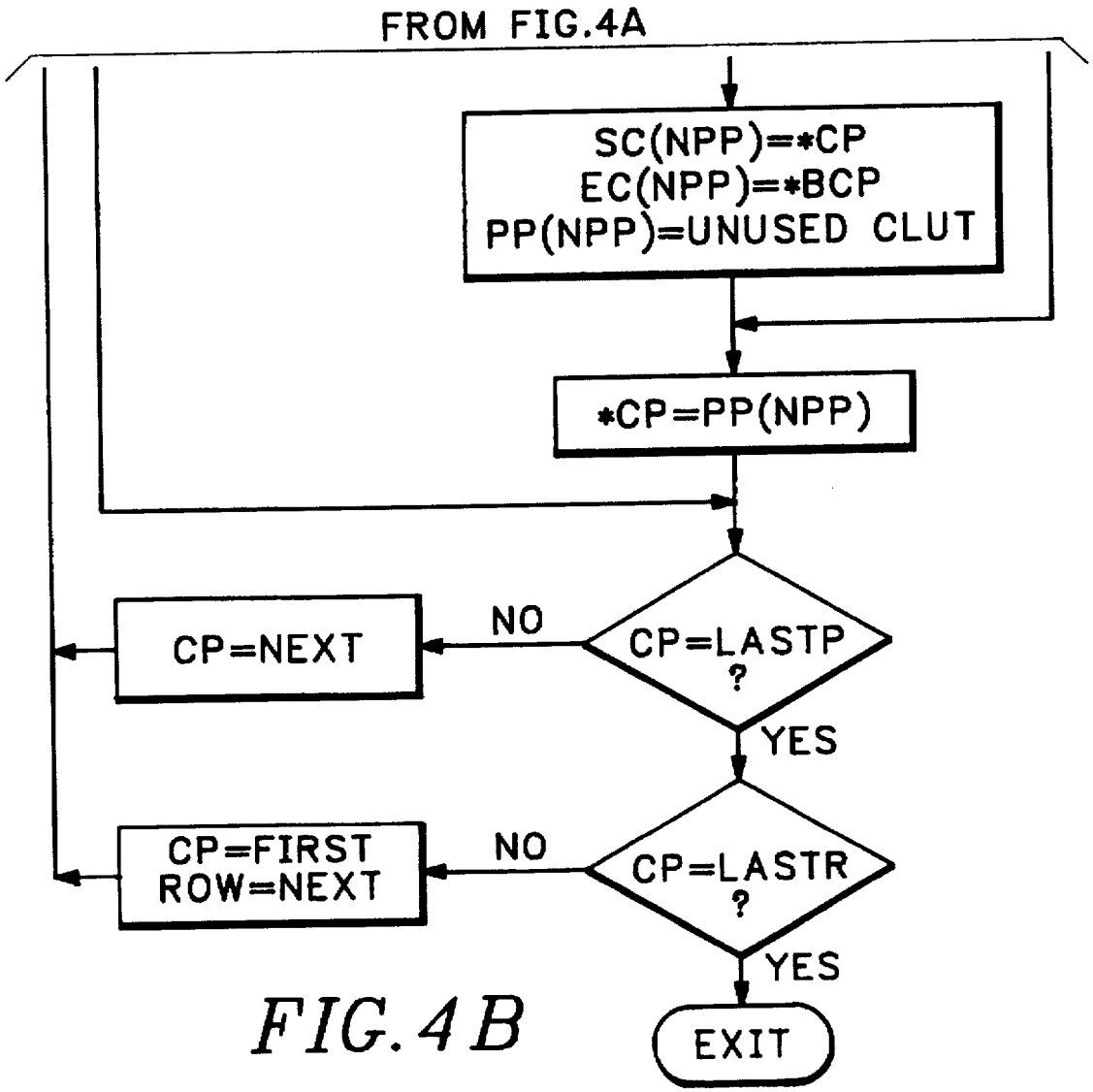
Figure 5:
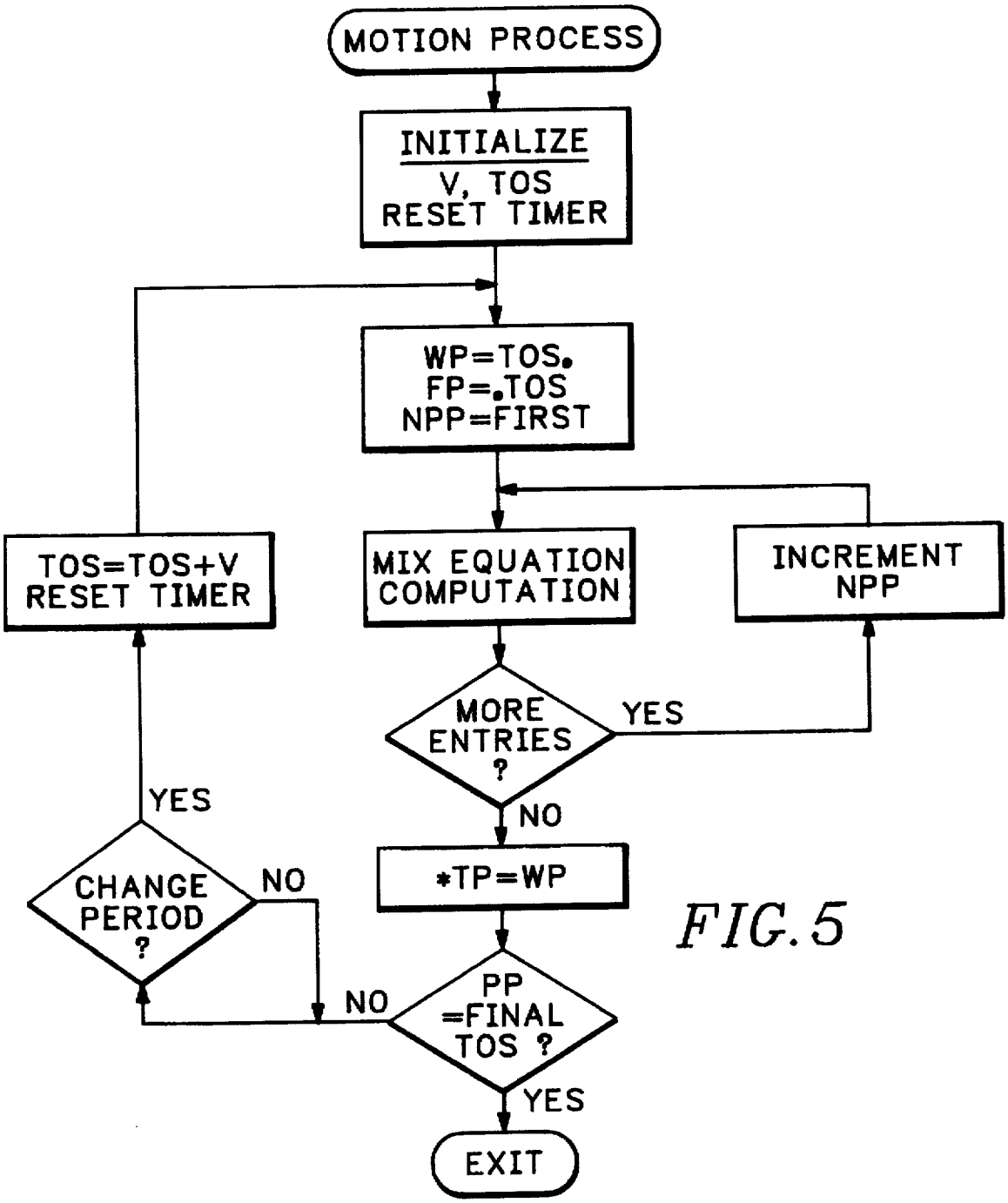
FIG. 5 is a flow chart of the motion process algorithm according to the present invention.

In operation the video data for the graphics image shown in FIG. 1*a* is stored by the CPU 30 in the display buffer 40 in the form of rows of pixels, each row corresponding to a scan line of the picture monitor 48 as shown in FIG. 1*b*. Once the video data is in the display buffer 40, the CPU 30 accesses a pre-processing algorithm, shown in FIG. 4, or the pre-processing may be performed prior to storing the graphics image in the display buffer. Referring now to FIGS. 4*a* and 4*b*, a current pixel (CP) pointer is initiated to be the first pixel in the first row to be processed. The current pixel CP and the pixel directly below the current pixel (BCP) are accessed and the respective color look-up numbers (CLUN) are extracted. A test is performed to determine whether a horizontal edge exists by comparing the CLUNs for the CP and BCP. If the CLUNs are equivalent, then the next pixel in the same row becomes the current pixel, or the first pixel in the next row becomes the current pixel where the current pixel was the last pixel of a row. If the current pixel is the last pixel in the last row to be processed, then the pre-processing is concluded.

If a horizontal edge is detected due to the inequality between the CLUNs for CP and BCP, then a filter array is created in the workspace 32 by the CPU 30 and a filter index (NPP) is initialized. The maximum size of the color look-up table 42 is the number of colors, M, assigned to represent a color data set for the graphics image plus the number of possible edge combinations from those colors, M!/(M−2)!. Thus, the color look-up table 42 has M×M palette positions, of which M are assigned palette positions and the remaining M×(M−1) palette positions are initially unassigned. The filter array is used to assign unused palette positions within the color look-up table 42 to the pixels above the horizontal edges. The first entry of the array is tested to determine whether the transition across the edge already has an entry in the array so that the CLUN for the CP does not have to be recomputed, but merely substituted for. If there is a new horizontal edge, or color transition, then there is no equality and the filter array is incremented to try to find a comparable transition within the array. If there are no comparable transitions, then a new filter array entry is created for the new transition if there are still available palette positions within the color look-up table 42. An unassigned palette position is then assigned to that transition in the filter array and to the current pixel, CP, in the display buffer.

Referring again to FIGS. 1*b* and 1*c*, as well as FIGS. 4*a* and 4*b*, the filter array initially has no entries and there are two unassigned palette positions where M=2. A first filter array entry for NPP=0 is established such that SC(0)=P0, EC(0)=P1 and the palette position PP(0)=P2 where SC is the start color, EC is the end color and P2 is the next available unused color palette position in the CLUT 42. For each subsequent transition from color P0 to color P1, i.e., the region identified as P2 in FIG. 1*c*, the CLUN for CP equals P0 and for BCP equals P1, so that P2 is assigned to each CP that exists above the horizontal edge from P0 to P1. At the bottom of the trapezoid the transition is from P1 to P0, for which the filter array has no entry and the comparison indicates that this is a new color transition. There is still one unassigned palette position so that a second entry is created as SC(1)=P1, EC(1)=P0 and PP(1)=P3. Thus the pixels for the graphics image of the trapezoid have the CLUNs assigned as indicated.

During each interval between display cycles, such as during the vertical interval of a television video display, new values for the CLUT 42 unassigned palette positions PP are computed. When motion is started or changed, a motion process algorithm is initiated by determining the incremental scan line movement per change period, V, as a function of the number of scan lines per frame, the change period and the roll time to move the frame completely off the raster display screen. The number of scan lines is a function of the type of video, such as NTSC with 525 scan lines per frame, PAL with 625 scan lines per frame, various HDTV schemes with 1050, 1125 or 1250 scan lines per frame, or any other non-television system having a specified number of scan lines per frame. The change period reflects how often the screen display may be updated, such as field or frame rates for television video or other arbitrary rates for other graphics applications. These two parameters are fixed as a function of the display hardware. The variable is the roll rate, or frame roll time, that determines the incremental scan line movement per change period, or display update. Also as part of the initialization process for the motion process algorithm TOS and TP are set to the top of the screen position within the data buffer 40, and a change period timer is reset.

The TOS value is divided into its whole part, WP, and its fractional part, FP, and the first filter array entry is accessed. For each filter array entry the color values for the indicated palette positions are computed and stored in those palette positions within the CLUT 42. For example referring to FIG. 2*b* where FP=0.25 the color value for PP(0), or P2, is $$*PP(0)=FP\times EC(0)+(1-FP)\times SC(0)\ P2=0.25\times(color\ X)+0.75\times(color\ Y)$$

After all the color values for the array have been computed and stored in the CLUT 42, then the top pointer, TP, is updated by WP, and, if the motion process is not complete, the change period timer is checked to determine whether the change period is complete. When the change period is complete, the change period timer is reset and TOS is incremented by V, and then new values from the filter array are computed. The filter array values may be precomputed into tabular form during preprocessing or may be computed at any time during a change period, either for the current change period prior to the display cycle or for the next change period during the display cycle, with the filter array values being transferred to the CLUT 42 prior to the next display cycle.

Thus the present invention provides smooth scrolling of a graphics image on a raster display using color palette manipulation by preprocessing the graphics image to assign unused palette positions to pixels at the top of a horizontal color edge, and then computing new color values for those palette positions for each display cycle as a function of the speed of motion.

What is claimed is:

1. A method of simulating smooth motion at a predetermined rate of a graphics image of M colors on a raster display, said method comprising the steps of:

(a) providing a display memory having memory locations that map pixel locations of the raster display;

(b) creating a color look-up table with, M×M palette positions;

(c) assigning color values representative of the M colors of the image to M palette positions respectively, leaving M×(M−1) initially unassigned palette positions;

(d) testing a current pixel of the image and a neighboring pixel at a predetermined position relative to said current pixel, and if there is a color transition between the current pixel and the neighboring pixel, determining whether the color transition matches a previously determined color transition, and if a match is not found, assigning the current pixel a previously unassigned palette position and calculating a new color value as a function of the color transition and said predetermined rate and assigning the new color value to said previously unassigned palette position, or if a match is found, assigning the current pixel the palette position corresponding to the matched color transition; and (e) repeating step (d) for other pixels of the image.

2. A method according to claim 1, wherein step (d) further comprises writing the palette position assigned to the current pixel to the memory location to which the location of the current pixel maps.

3. A method according to claim 2, further comprising reading palette positions from the display memory, addressing the look-up table with the palette positions, reading color values from the look-up table, and employing the color values to display the graphics image.

4. A method according to claim 1, comprising, between steps (c) and (d):

receiving image data from a display source;

determining the color values for said M colors of the image; and for each of the M colors, writing the palette position assigned to that color to the memory locations of said display memory to which the locations of pixels of that color map.

5. A method for simulating smooth vertical motion at a predetermined rate of a graphics image of M colors on a raster display, said method comprising the steps of:

(a) providing a display memory having memory locations that map to pixel locations of the raster display;

(b) creating a color look-up table with M×M palette positions;

(c) assigning color values representative of the M colors of the image to M palette positions respectively, leaving M×(M−1) initially unassigned palette positions;

(d) testing a current pixel of the image and the pixel immediately below the current pixel, and if there is a color transition between the current pixel and the pixel immediately below the current pixel, determining whether the color transition matches a previously determined color transition, and if a match is not found, assigning the current pixel a previously unassigned palette position and calculating a new color value as a function of the color transition and said predetermined rate and assigning the new color value to said previously unassigned palette position, or if a match is found, assigning the current pixel the palette position corresponding to the matched color transition; and (e) repeating step (d) for other pixels of the image.

6. A method of preprocessing a graphics image for producing smooth motion at a predetermined rate of said graphics image on a raster display, said method comprising the steps of:

determining new color transitions for color edges of the image that are unique from other color transitions already determined and processed;

if a new color transition is determined, assigning to a transition pixel associated with said color transition a previously unassigned palette position of a color look-up table, calculating a new color value for the new color transition as a function of said predetermined rate, and writing the new color value to said previously unassigned palette position; and if a new color transition is not determined, assigning to the transition pixel the palette position associated with one of said other color transitions.

7. An apparatus for simulating smooth motion at a predetermined rate of a graphics image of M colors on a raster display, said apparatus comprising:

a display memory having memory locations that map pixel locations of the raster display;

a color look-up table with M×M palette positions;

processing means for assigning color values representative of the M colors of the image to M palette positions respectively, and leaving M×(M−1) initially unassigned palette positions;

means for sequentially testing each pixel of the image and comparing its color with that of a neighboring pixel and determining the presence of a color transition between the tested pixel and the neighboring pixel;

filtering means for determining and reporting a match if the determined color transition matches a previously determined color transition; and means for either assigning the tested pixel a previously unassigned palette position and calculating a new color value as a function of the color transition and said predetermined rate if the filtering means does not report said match or alternatively, if the filtering means reports said match, assigning the tested pixel the palette position corresponding to the matched color transition.

8. An apparatus according to claim 7 for simulating smooth vertical motion, wherein the means for sequentially testing each pixel and comparing its color with that of a neighboring pixel is operative to compare the color of the tested pixel with that of the pixel immediately below the tested pixel.

9. An apparatus according to claim 7, wherein the display memory comprises an input means for receiving image data from a display source, and the apparatus further comprises a means for reading and displaying the graphics image from the display memory.

10. An apparatus according to claim 9, further comprising:

a means for determining the color values for the M colors of the image; and a means for writing the palette positions representative of the M colors to respective memory locations of said display memory.

11. A graphics preprocessing apparatus for producing smooth motion at a predetermined rate of a graphics image on a raster display comprising:

means for determining new color transitions for color edges of the image that are unique from other color transitions already determined and processed;

means for calculating a new color value for each new color transition and assigning the new color value to a previously unassigned palette position of a color look-up table; and means for writing the previously unassigned palette position to a memory location associated with said new color transition and writing a palette position corresponding to one of said other color transitions to a memory location not associated with the new color transition.

12. An apparatus for performing smooth vertical motion of a graphics image on a raster display comprising:

means for storing the image in the form of pixels;

a color look-up table having M assigned palette positions where M is the number of colors in the image and each assigned palette position has a unique color value from among the M colors, and having M×(M−1) initially unassigned palette positions;

means for accessing the storing means to select a current pixel and the pixel immediately below the current pixel;

means for determining the presence of a color transition between the current pixel and the pixel immediately below the current pixel;

means to determine if the color transition is a new color transition;

means for determining a new color value as a function of a specified rate of vertical movement and assigning said new color value to an unassigned palette position of the color look-up table as a new palette position if said color transition is new;

means for writing to the current pixel associated with the color transition either said new unassigned palette position of the color look-up table if the color transition is new or alternatively the palette position corresponding to a previously determined color transition if the color transition is not new; and means for reading and displaying the graphics image from the storing means.

* * * * *